US005813964A

United States Patent [19]

Motomura

[11] Patent Number: 5,813,964

[45] Date of Patent: Sep. 29, 1998

[54] FORMING ROLLER OR SUPPORTING MATERIAL WEB USED IN LIQUID CONTAINER

[75] Inventor: Tatsumi Motomura, Ageo, Japan

[73] Assignee: Tetra Laval Holdings & Finance S.A., Pully, Switzerland

[21] Appl. No.: 868,144

[22] Filed: Jun. 3, 1997

Related U.S. Application Data

[63] Continuation of Ser. No. 470,799, Jun. 6, 1995, abandoned.

[30] Foreign Application Priority Data

Jun. 6, 1994 [JP] Japan ..... 6-148563

[51] Int. Cl.[6] ..... B65H 45/08; B65B 9/06; B65B 9/10

[52] U.S. Cl. ..... 493/302; 53/551; 53/552

[58] Field of Search ..... 493/295, 302, 493/308; 413/71, 72, 73, 74; 53/551, 552, 554; 226/190, 192; 242/615.2; 254/398; 198/819, 825

[56] References Cited

U.S. PATENT DOCUMENTS

| | | | |
|---|---|---|---|
| 1,072,715 | 9/1913 | Harbeck | 493/302 |
| 1,985,997 | 1/1935 | Keeran | 493/295 |
| 2,731,132 | 1/1956 | Socke | 413/71 |
| 2,832,271 | 4/1958 | Jarund et al. . | |
| 3,005,583 | 10/1961 | Butscher | 226/192 |
| 3,133,626 | 5/1964 | Kidd | 198/825 |
| 3,235,940 | 2/1966 | Taylor et al. | 226/190 |
| 3,964,658 | 6/1976 | Edwards | 226/190 |
| 3,981,129 | 9/1976 | Briaire | 226/190 |
| 4,107,900 | 8/1978 | Izumi | 53/555 |
| 4,289,230 | 9/1981 | McGee | 198/825 |
| 4,784,697 | 11/1988 | Bordini | 53/551 |
| 4,947,013 | 8/1990 | Rölli | 413/71 |
| 5,067,311 | 11/1991 | Andersson | 493/302 |
| 5,235,794 | 8/1993 | Center | 53/552 |
| 5,273,197 | 12/1993 | Wenk | 226/190 |
| 5,279,098 | 1/1994 | Fukuda | 53/552 |

FOREIGN PATENT DOCUMENTS

| | | | |
|---|---|---|---|
| 91712 | 10/1983 | European Pat. Off. | 523/551 |
| 302413 | 7/1988 | European Pat. Off. . | |
| 427027 | 10/1990 | European Pat. Off. . | |
| 795015 | 11/1955 | United Kingdom . | |

*Primary Examiner*—Jack W. Lavinder
*Attorney, Agent, or Firm*—Loeb & Loeb LLP

[57] ABSTRACT

A forming roller or a supporting roller for a packaging material web used for a liquid container according to the present invention comprises a plurality of rollers with outer peripheral surface thereof curved in axial direction of a rotating shaft, and the plurality of rollers are arranged at positions for forming a planar packaging material web into tubular shape or at positions for supporting the packaging material web after it has been formed into tubular shape. Each roller is divided into a plurality of roller portions by planes perpendicular to a rotating shaft thereof. The packaging material web is passed between the plurality of rollers, and the surface of the packaging material web is brought into contact with outer peripheral surface of the plurality of rollers. When said packaging material web is transported, each of the divided roller portions of the rollers is independently rotated. In this case, the roller portion having a smaller diameter is more quickly rotated than the roller portion with a larger diameter, and there will be no big difference in peripheral speed between the outer peripheral surfaces of the rollers. As a result, resistance of the rollers to the packaging material web is reduced, and the packaging material web is passed more smoothly.

14 Claims, 2 Drawing Sheets

FORMING ROLLER OR SUPPORTING MATERIAL WEB USED IN LIQUID CONTAINER

This is a continuation of application Ser. No. 08/470,799 filed on Jun. 6, 1995, now abandoned.

BACKGROUND OF THE INVENTION

The present invention relates to a forming roller or a supporting roller for a packaging material web used in a liquid container, said roller being mounted for forming a planar packaging material web into tubular shape, or mounted for supporting a packaging material web after it has been formed into tubular shape.

Conventionally, a liquid container has been used, which is produced by forming a packaging material comprising a polyethylene layer on both sides of a piece of paper in a brick-like container and liquid foods such as milk, juice, etc. are filled into it.

On the other hand, a liquid packaging apparatus has been developed, which is used to fill liquid foods into a liquid container while the latter is being formed. That is, in this liquid packaging apparatus, a packaging material web in belt-like shape is processed by various types of treatment such as sterilization and is gradually formed into tubular shape by rollers for forming, and liquid is filled into it while integrally bonding longitudinal edges on both sides. The packaging material web formed in tubular shape is held by rollers for supporting and is carried toward an apparatus called a jaw unit, and it is sealed and cut off at equal spacings by the jaw unit and is formed into brick-like shape.

Forming rollers or supporting rollers of conventional type used in this type of liquid packaging apparatus comprise a plurality of rollers. Outer peripheral surface of each roller is curved in arcuate configuration in axial direction of the shaft of the rollers. Said plurality of rollers are arranged in such manner that they form approximately a single circular curve or a curve closer to a circle with outer peripheral surface of each side of the rollers. The packaging material web is passed between these rollers.

The forming rollers are used to gradually form the belt-like packaging material web into tubular shape by passing the packaging material web between the rollers.

On the other hand, the supporting rollers are mounted at a position where the packaging material web is formed into tubular shape and liquid is filled in it and where it has been before it is sealed, cut and formed by a jaw unit. The supporting rollers are mounted such that the packaging material web formed in tubular shape is properly positioned to stabillize its flow and the packaging material web formed in tubular shape is properly formed when it is formed into brick-like shape.

However, in a plurality of rollers consituting the conventional type forming rollers or supporting rollers, the diameter at the central portion is considerably different from the diameter on two end portions. Therefore, when the rollers are rotated, the peripheral speed of the outer peripheral surface of each roller greatly varies from place to place. As a result, when the packaging meterial web is guided by these rollers along the web, slip between the rollers and the packaging material web increases, thereby causing resistance against the transport of the packaging material web and making the flow of the web unstable.

From this, in the case of the forming rollers, defective forming may occur. In case of the supporting rollers, defective forming also may occur in the forming process by the jaw unit.

SUMMARY OF THE INVENTION

It is an object of the present invention to provide a forming roller or a supporting roller for a packaging material web used in a liquid container, whereby resistance is very unlikely to occur to the transport of the packaging material web.

To attain the above object, the forming roller or the supporting roller for a packaging material web used for a liquid container according to the present invention comprises a plurality of rollers with outer peripheral surface curved in an axial direction of a shaft, said plurality of rollers being arranged at positions for forming the packaging material web of planar shape into tubular shape or at positions for supporting the packaging material web after it has been formed in tubular shape, the packaging material web is passed through said plurality of rollers, and the surface of the packaging material web is brought into contact with the outer peripheral surface of said plurality of rollers, whereby each of said rollers is divided into a plurality of roller portions by planes perpendicular to a shaft thereof.

According to the present invention, when the packaging material web is passed through a plurality of rollers, each of the divided roller portions of the rollers is rotated independently from each other. The roller portion having a smaller diameter is more quickly rotated than the roller portion with a larger diameter, and there is no big difference in peripheral speed between outer peripheral surfaces of the roller portions of the rollers. Accordingly, the resistance of the rollers to the packaging material web is reduced.

As a result, the packaging material web flows more smoothly and stably, and the load on the motor to feed the packaging material web can also be reduced.

DESCRIPTION OF THE PREFERRED EMBODIMENTS

In the following, detailed description will be given on embodiments of the present invention in connection with the drawings.

Figure 4:
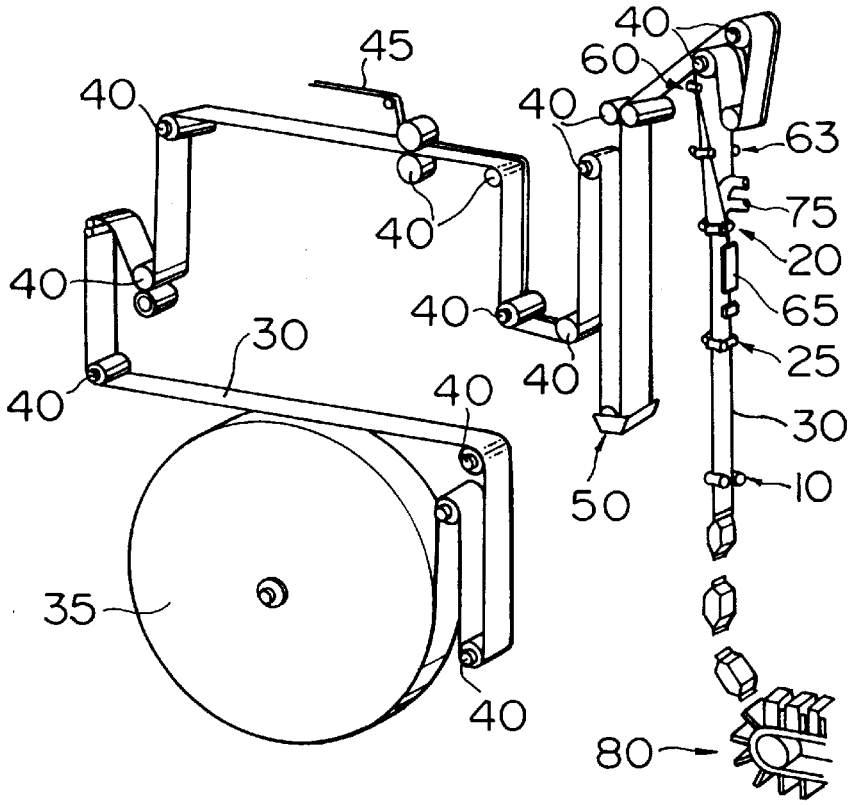
FIG. 4 is a schematical perspective view showing treatment process of a packaging material web 30 in a liquid packaging apparatus.

FIG. 4 is a schematical perspective view showing treatment process of a packaging material web in a liquid packaging apparatus. As shown in this figure, a packaging material web 30, comprising a polyethylene layer each formed on both sides of a belt-like piece of paper (an aluminum layer or an aluminum foil may be arranged between paper and polyethylene layer when necessary) is wound around a roll 35.

After being drawn out of the roll 35, the packaging material web 30 passes through a number of rollers 40 and is carried along above the roll 35. A strip tape 45 drawn out of another roll (not shown) is attached on the web, which is then passed through several rollers and is sterilized with hydrogen peroxide water in a sterilizer unit 50.

The packaging material web 30 thus carried upward is further passed through several rollers 40 and is then guided downward in vertical direction.

By upper forming rollers 60 and 63, arranged along the moving route of the packaging material web 30 guided downward in vertical direction, the packaging material web 30 of planar shape is gradually formed closer into tubular shape. Further, it is formed by the upper forming rollers 20 until two longitudinal edges of the packaging material web 30 are overlapped each other.

Next, by a preheater 65 arranged under the upper forming rollers 20, the overlapped longitudinal edges are heated and the web is passed through lower forming rollers 25. By a welding unit (not shown) mounted in the lower forming rollers 25, the longitudinal edges of the packaging material web 30 are welded together, and it is formed to a complete tube.

After the packaging material web 30 formed to a complete tube is passed through supporting rollers 10, it is sealed and cut at equal spacings by a device called a jaw unit (not shown) and is simultaneously formed into brick shape. Finally, it is turned to a brick-like packaging container approximately in shape of parallelopiped by a final folding unit 80.

Figure 1:
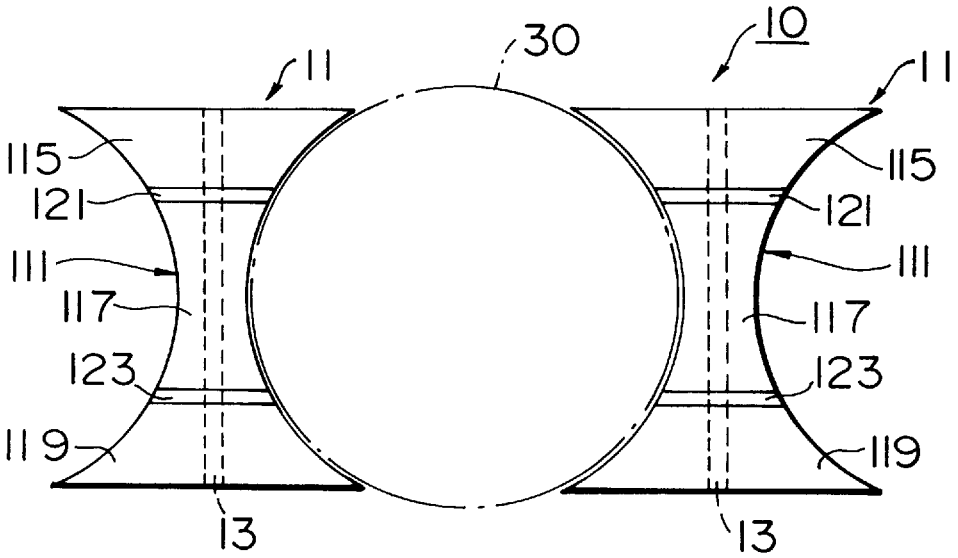
FIG. 1 is a schematical plan view of supporting rollers 10 of an embodiment of the present invention.

Here, FIG. 1 represents a schematical plan view of the supporting rollers 10 according to the present invention. The supporting rollers 10 comprise rollers 11 and 11 having identical shape, and each of these rollers is divided into three roller portions of 115, 117 and 119 by planes perpendicular to shafts 13 and 13. Each of the rollers 115, 117 and 119 is mounted on the shaft 13 so that it can be independently rotated. Between the adjacent roller portions of 115, 117 and 119, shims 121 and 123 in form of thin disk are inserted.

Outer peripheral surface 111, defined by the roller portions 115, 117 and 119 including the shims 121 and 123 of the rollers 11, is formed in arcuate shape so that it has smaller diameter at the central portion in axial direction of the shaft 13 and larger diameter on two end portions.

The rollers 11 and 11 are arranged in such manner that a circular space is defined by the outer peripheral surfaces 111 and 111, and the packaging material web 30 formed in tubular shape passes through inside. The outer peripheral surfaces 111 and 111 of the rollers 11 and 11 are coated with Teflon.

The shims 121 and 123 are inserted between the rollers because, if the rollers 11 in undivided condition are cut by a cutter, axial length of the rollers 11 is shortened by the thickness of the cutter, and the outer peripheral surface 111 may loose arcuate shape as required. The insertion of the shims 121 and 123 is to prevent this.

In case outer peripheral shape of each of the roller portions 115, 117 and 119 is formed so that arcuate shape can be maintained without inserting the shims 121 and 123, the shims 121 and 123 are not required.

The supporting rollers 10 are provided as described above, and the packaging material web 30 formed in tubular shape is passed through a circular space defined by outer peripheral surfaces 111 and 111 of the rollers 11 and 11. Then, the divided roller portions 115, 117 and 119 of the rollers 11 and 11 are rotated independently from each other. More concretely, the central roller portion 117 is rotated more rapidly than the roller portions 115 and 119 at both ends, and there will be no substantial difference in peripheral speed between the outer peripheral surfaces 111 and 111 of the rollers 11 and 11.

Thererfore, the resistance of the rollers 11 and 11 to the packaging material web 30 is lower compared with the conventional type rollers. This makes the flow of the packaging material web 30 more smooth and stable. At the same time, it is possible to reduce load of a motor (not shown) to feed the packaging material web 30. Accordingly, when the packaging material web 30 is formed into brick-like shape by the jaw unit in the subsequent stage, the forming process can be achieved more accurately and smoothly.

Figure 2:
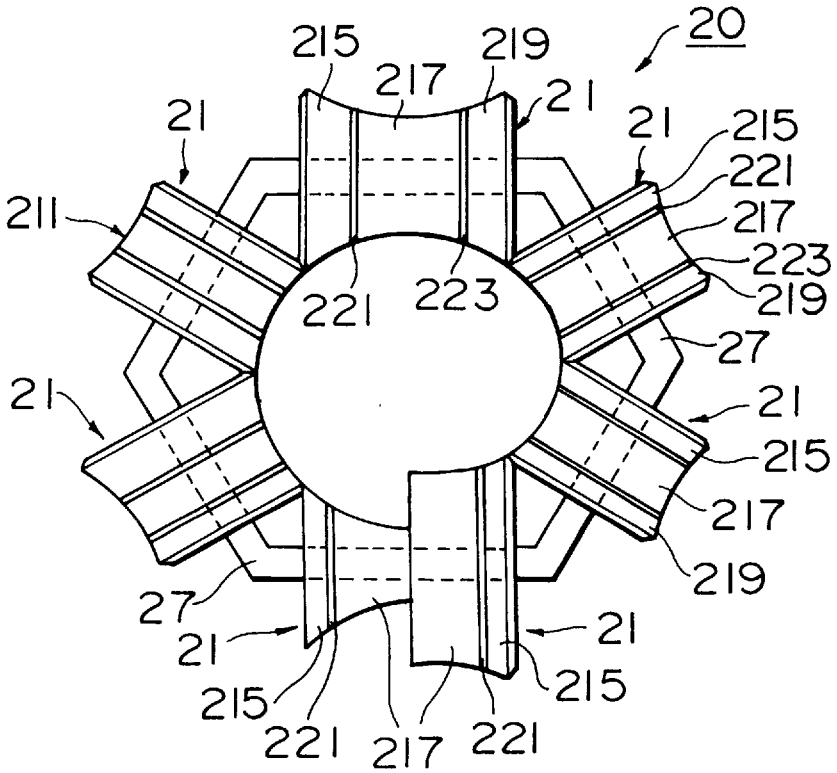
FIG. 2 is a schematical plan view of upper forming rollers 20 of an embodiment of the present invention.

FIG. 2 is a schematical plan view of the upper forming rollers 20 according to the present invention. The upper forming rollers 20 comprise seven rollers 21 with different shapes arranged in ring-like configuration.

Each of the rollers 21 is divided into two or three roller portions 215, 217 and 219 by planes perpendicular to a shaft 27. The roller portions 215, 217 and 219 are mounted on the shaft 27 so that the roller portions are independently rotated. Between the adjacent roller portions of 215, 217 and 219, shims 221 and 223 in form of thin disk (one shim 221 in case of the rollers 21, which comprises only two roller portions of 215 and 217) are inserted.

By passing the packaging material web 30 through seven rollers 21, the packaging material web 30 is formed so that it is turned to the condition immediately before the two longitudinal edges have been connected together. In this case, the divided roller portions 215, 217 and 219 of the rollers 21 are independently rotated. Accordingly, there will be no big difference between peripheral speed between the outer peripheral surfaces 211 of the rollers 21, and the resistance of the rollers 21 to the packaging material web 30 will be low. As a result, the packaging material web 30 flows more smoothly and stably. Therefore, the packaging material web 30 can be formed more accurately and smoothly.

Figure 3:
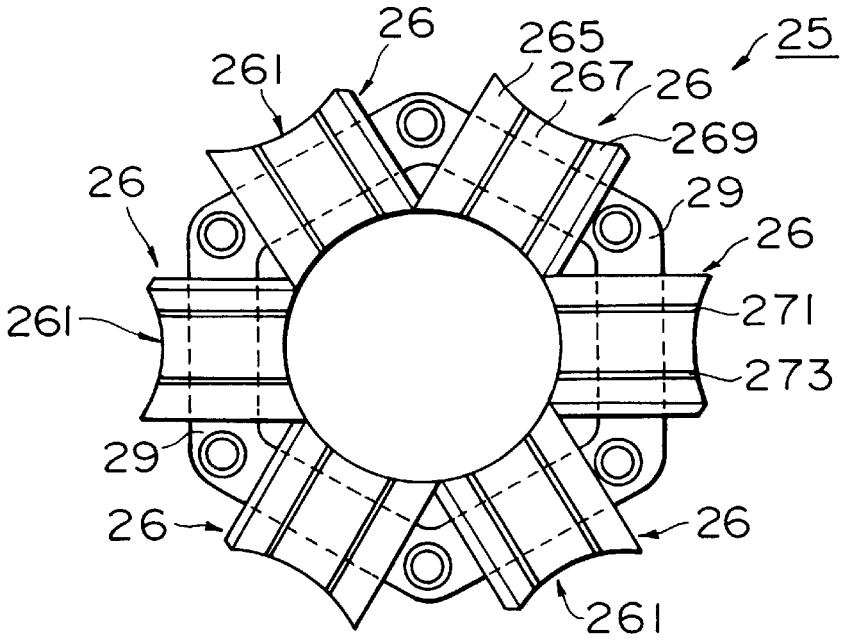
FIG. 3 is a schematical plan view of lower molding rollers 25 of an embodiment of the present invention.

FIG. 3 is a schematical plan view of the lower forming rollers 25 according to the present invention. The lower forming rollers 25 comprise six rollers 26 having identical shape arranged in ring-like configuration.

Like the embodiments as described above, in the lower forming rollers 25, each of the rollers 26 is also divided into three roller portions 265, 267 and 269, and each of them is mounted on a shaft 29 so that they are independently rotated. Between the adjacent roller portions of 265, 267 and 269, shims 271 and 273 are inserted.

By passing the packaging material web 30 through a circular space defined by outer peripheral surfaces 261 of these six rollers 26, the packaging material web 30 can be formed in complete ring-like configuration. In this case, the divided roller portions 265, 267 and 269 of the roller 26 are independently rotated. As a result, the packging material web 30 is passed smoothly and stably. Accordingly, the packaging material web 30 can be formed into tubular shape more accurately and smoothly.

In the above embodiments, each of the forming or supporting rollers is divided into two or three roller portions, while the present invention is not limited to these embodiments, and the rollers may be divided into four or more, and speed on outer peripheral surfaces of roller portions may be equalized.

Also, the present invention may be applied to a portion other than the portions described above, e.g. to the rollers of the upper forming rollers 60 and 63 shown in FIG. 4.

It is needless to say that various changes and modifications can be made without departing from the spirit or major features of the present invention. The above embodiments are simply given for exemplary purpose in every respect and should not be interpreted as limitative. The scope of the present invention is defined by the claims attached hereto and is in no way bound by the description in the specification. Any modification or change belonging to the scope of eguivalents in the claims is within the scope of the present invention.

What we claim is:

1. A roller device for at least one of forming and supporting a packaging material web used for a liquid container, the roller device comprising:

at least one pair of opposing rollers, each of the at least one pair of opposing rollers having a shaft, each of the at least one pair of rollers being divided into a plurality of independently rotatable roller portions by planes that are substantially perpendicular to the shaft, each of the plurality of independently rotatable roller portions having an outer peripheral surface curved relative to the shaft, the outer peripheral surfaces of the plurality of independently rotatable roller portions of the at least one pair of rollers defining a generally complete circular surface, and each of the plurality of independently rotatable roller portions being independently rotatable to have a generally uniform peripheral speed along the generally complete circular surface.

2. A roller device as defined in claim 1, wherein the at least one pair of opposing rollers are arranged for at least one of forming a substantially planar packaging material web into a substantially tubular shape and supporting a substantially tubular shaped packaging material web, the at least one pair of opposing rollers are further arranged so that the substantially tubular shaped packaging material web passes therebetween and is brought into contact with the generally complete circular surface defined by the outer peripheral surfaces of the plurality of independently rotatable roller portions of the at least one pair of opposing rollers.

3. A roller device as defined in claim 2, wherein the generally complete circular surface defined by the outer peripheral surfaces of the plurality of independently rotatable roller portions of the plurality of rollers substantially contacts an entire periphery of the substantially tubular shaped packaging material web.

4. An apparatus for forming a web of packaging material into a tubular configuration, comprising:

a tubular web forming section for forming the web of packaging material into a tubular configuration; and at least one roller device provided at the tubular web forming section for at least one of forming and supporting the web of packaging material, the roller device comprising a plurality of rollers, each of the plurality of rollers having a shaft, each of the plurality of rollers being divided into a plurality of independently rotatable roller portions by planes that are substantially perpendicular to the shaft, each of the plurality of independently rotatable roller portions having an outer peripheral surface curved relative to the shaft, the outer peripheral surfaces of the plurality of independently rotatable roller portions of the plurality of rollers defining a generally complete circular surface, and each of the plurality of independently rotatable roller portions being independently rotatable to have a generally uniform peripheral speed along the generally complete circular surface.

5. An apparatus as defined in claim 4, wherein the plurality of rollers are arranged for at least one of forming a substantially planar packaging material web into a substantially tubular shape and supporting a substantially tubular shaped packaging material web, the plurality of rollers are further arranged so that the substantially tubular shaped packaging material web passes therebetween and is brought into contact with the generally complete circular surface defined by the outer peripheral surfaces of the plurality of rollers.

6. An apparatus as defined in claim 5, wherein the generally complete circular surface defined by the outer peripheral surfaces of the plurality of independently rotatable roller portions of the plurality of rollers substantially contacts an entire periphery of the substantially tubular shaped packaging material web.

7. An apparatus as defined in claim 5, wherein at least one of the independently rotatable roller portions in at least one of the plurality of rollers defines a stepped section in the generally complete circular surface.

8. An apparatus as defined in claim 5, wherein the tubular web forming section generally vertically supports the substantially tubular shaped packaging material web.

9. An apparatus as defined in claim 8, wherein three sets of the roller devices are vertically arranged along the tubular web forming section to generally vertically support the substantially tubular shaped packaging material web.

10. A roller device for at least one of forming and supporting a packaging material web used for a liquid container, the roller device comprising:

a plurality of rollers, each of the plurality of rollers having a shaft and an outer peripheral surface curved relative to the shaft, each of the rollers being divided into a plurality of independently rotatable roller portions by planes that are substantially perpendicular to the shaft, each of the plurality of independently rotatable roller portions having a peripheral curved surface, the peripheral curved surfaces of the plurality of independently rotatable roller portions of the plurality of rollers defining a generally complete circular surface, the plurality of rollers being arranged for at least one of forming a substantially planar packaging material web into a substantially tubular shape and supporting a substantially tubular shaped packaging material web, the plurality of rollers being further arranged so that the substantially tubular shaped packaging material web passes therebetween and is brought into contact with the peripheral curved surfaces of the plurality of independently rotatable roller portions of the plurality of rollers along the generally complete circular surface, wherein each of the plurality of independently rotatable roller portions is independently rotatable at a different speed.

11. A roller device for at least one of forming and supporting a packaging material web used for a liquid container, the roller device comprising:

a plurality of rollers, each of the plurality of rollers having a shaft and being divided into a plurality of independently rotatable roller portions by planes that are substantially perpendicular to the shaft, each of the independently rotatable roller portions defining an outer peripheral curved surface curved relative to the shaft, the outer peripheral curved surfaces of the plurality of independently rotatable roller portions of the plurality of rollers defining a generally complete circular surface, and each of the plurality of independently rotatable roller portions being independently rotatable to have a generally uniform peripheral speed along the generally complete circular surface.

12. A roller device as defined in claim 3, wherein the generally complete circular surface generally defines a center and the plurality of rollers are arranged about the center of the generally complete circular surface for at least one of forming a substantially planar packaging material web into a substantially tubular shape and supporting a substantially tubular shaped packaging material web, so that the substantially tubular shaped packaging material web passes therebetween and is brought into contact with the generally complete circular surface defined by the outer peripheral curved surfaces of the plurality of independently rotatable roller portions of the plurality of rollers.

13. A roller device as defined in claim 12, wherein the generally complete circular surface defined by the outer peripheral curved surfaces of the plurality of independently rotatable roller portions substantially contacts an entire periphery of the substantially tubular shaped packaging material web.

14. A roller device as defined in claim 12, wherein the plurality of rollers generally vertically support the substantially tubular shaped packaging material web.

* * * * *